US009940946B2

(12) United States Patent
Xie et al.

(10) Patent No.: US 9,940,946 B2
(45) Date of Patent: Apr. 10, 2018

(54) SHARP NOISE SUPPRESSION

(71) Applicant: Marvell World Trade Ltd., St. Michael (BB)

(72) Inventors: Jin Xie, Longmont, CO (US); Sungyub Daniel Yoo, San Jose, CA (US); Kapil Jain, Santa Clara, CA (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

(21) Appl. No.: 15/252,068

(22) Filed: Aug. 30, 2016

(65) Prior Publication Data

US 2017/0084291 A1 Mar. 23, 2017

Related U.S. Application Data

(60) Provisional application No. 62/222,520, filed on Sep. 23, 2015.

(51) Int. Cl.

| | |
|---|---|
| ***G10L 21/0208*** | (2013.01) |
| ***G10L 25/78*** | (2013.01) |
| ***G10L 21/034*** | (2013.01) |
| *G10L 21/0232* | (2013.01) |

(52) U.S. Cl.

CPC ..... *G10L 21/034* (2013.01); *G10L 21/0208* (2013.01); *G10L 25/78* (2013.01); *G10L 21/0232* (2013.01)

(58) Field of Classification Search

CPC ..... G10L 21/0208; G10L 25/78

See application file for complete search history.

(56) References Cited

U.S. PATENT DOCUMENTS

| | | | | |
|---|---|---|---|---|
| 5,687,285 | A * | 11/1997 | Katayanagi | G10L 21/0208 381/312 |
| 6,249,757 | B1 * | 6/2001 | Cason | G10L 25/78 370/289 |
| 6,795,559 | B1 * | 9/2004 | Taura | H04B 1/1027 381/94.4 |
| 7,903,825 | B1 * | 3/2011 | Melanson | H03G 3/32 381/103 |
| 9,276,618 | B1 | 3/2016 | Xie et al. | |
| 2005/0175192 | A1 * | 8/2005 | Herman | H04R 3/00 381/94.7 |
| 2009/0175466 | A1 * | 7/2009 | Elko | H04R 3/005 381/94.2 |
| 2010/0017203 | A1 * | 1/2010 | Archibald | G10L 25/78 704/208 |
| 2011/0268301 | A1 * | 11/2011 | Nielsen | G10L 21/02 381/321 |

(Continued)

*Primary Examiner* — Paras D Shah
*Assistant Examiner* — Bryan Blankenagel

(57) ABSTRACT

A method includes determining a first filtered signal based on an audio signal; determining a second filtered signal based on the audio signal; determining, based on the first filtered signal and the second filtered signal, a portion of the audio signal corresponding to a sharp noise; determining, based on the first filtered signal and the second filtered signal, a gain signal that, for the portion of the audio signal corresponding to the sharp noise, has a value that is smaller than a value of the gain signal for the remaining portion of the audio signal; and suppressing, based on the gain signal, the sharp noise from an amplifier input signal determined based on the audio signal.

19 Claims, 12 Drawing Sheets

(56) References Cited

U.S. PATENT DOCUMENTS

| | | | | |
|---|---|---|---|---|
| 2012/0020495 | A1* | 1/2012 | Sekiya | G10L 21/0208 381/94.3 |
| 2013/0013304 | A1* | 1/2013 | Murthy | G10L 21/0208 704/226 |
| 2014/0161271 | A1* | 6/2014 | Teranishi | H04R 5/04 381/71.7 |
| 2015/0078567 | A1* | 3/2015 | Mani | G10K 11/175 381/66 |
| 2015/0281853 | A1* | 10/2015 | Eisner | H04R 25/505 381/312 |

* cited by examiner

*Key*:
225 – $N_R$ or reference noise;
253 – $A_F$ or fast amplitude;
255 – $A_S$ or slow amplitude;
257 – G or suppression gain.

SHARP NOISE SUPPRESSION

CROSS-REFERENCE TO RELATED APPLICATIONS

This disclosure claims priority to U.S. Provisional Application Ser. No. 62/222,520, filed Sep. 23, 2015, the disclosure of which is incorporated herein by reference in its entirety.

BACKGROUND

The present disclosure is generally related to technologies used for suppressing sharp noise from audio signals, and more specifically for suppressing sharp noise from a preprocessed audio signal based on information determined from reference noise associated with the preprocessed audio signal.

A signal receiver can receive a target signal that arrives at the signal receiver along a predetermined direction and an ambient noise signal (or simply ambient noise) that arrives at the signal receiver along one or more directions different from the predetermined direction. For example, an audio receiver of a mobile device receives (i) a speech signal (or simply speech) that arrives at the audio receiver along a "speech direction", from where a user of the mobile device is expected to speak, and (ii) ambient noise along other directions, different from the speech direction.

As a level of typical ambient noise is lower than a level of the target signal, conventional technologies can be used for suppressing the ambient noise without distorting the target signal, thus forming a "beam" of the target signal that appears to have been received at the signal receiver along the predetermined direction. However, if the ambient noise includes portions of sharp noise, characterized by short durations during which a level of the sharp noise exceeds the level of the target signal, then the portions of the sharp noise will be included in the formed beam of the target signal, when such conventional technologies are used for suppressing the ambient noise. In the foregoing example of the audio receiver, as a level of the typical ambient noise is lower than a level of the speech, conventional technologies can be used for suppressing the ambient noise without distorting the speech, thus forming a "speech beam" that appears to have been received at the audio receiver along the speech direction. However, if the ambient noise includes portions of sharp noise, e.g., sharp noise caused by a plate hitting the floor or by keyboard clicks, such that a level of the sharp noise exceeds the level of the speech, then the portions of the sharp noise will be included in the formed speech beam, when conventional technologies are used for suppressing the ambient noise.

SUMMARY

In this disclosure, technologies are described that can be used to suppress sharp noise from a preprocessed signal, e.g., from a beam of target signal, based on information determined from a noise-indicating signal (also referred to as reference noise) associated with the preprocessed signal. For example, the disclosed technologies can be used to suppress sharp noise, e.g., sharp noise caused by a plate hitting the floor or by keyboard clicks, from a speech beam based on information determined from reference noise, where the reference noise is a byproduct of the forming of the speech beam.

One aspect of the disclosure can be implemented as a method that includes determining a first filtered signal based on an audio signal, determining a second filtered signal based on the audio signal; determining, based on the first filtered signal and the second filtered signal, a portion of the audio signal corresponding to a sharp noise; determining, based on the first filtered signal and the second filtered signal, a gain signal that, for the portion of the audio signal corresponding to the sharp noise, has a value that is smaller than a value of the gain signal for the remaining portion of the audio signal; and suppressing, based on the gain signal, the sharp noise from an amplifier input signal determined based on the audio signal.

Implementations can include one or more of the following features. In some implementations, the determining of the first filtered signal can include using a first low pass filter having a first cutoff frequency on the magnitude of the audio signal when a magnitude of a change of the first filtered signal is less than a magnitude of a threshold; limiting an increase of the first filtered signal to a positive value of the threshold when the first filtered signal increases by more than the positive value of the threshold; and limiting a decrease of the first filtered signal to a negative value of the threshold when the first filtered signal decreases by more than the negative value of the threshold. In some cases, a ratio of the magnitude of the threshold and a root mean square (RMS) variation of the audio signal can be in a range from 1e-4% to 1e-2%. In some cases, the determining of the second filtered signal can include using a second low pass filter having a second cutoff frequency on a magnitude of the audio signal. For example, the second cutoff frequency can be larger than or equal to the first cutoff frequency.

In some implementations, the portion of the audio signal determined to be associated with the sharp noise can correspond to times when a biased value of the first filtered signal is smaller than or equal to a value of the second filtered signal. Here, the determining of the gain signal can include setting, for the portion of the audio signal determined to be associated with the sharp noise, a value of the gain signal to a ratio of the biased value of the first filtered signal to the value of the second filtered signal; and setting, for the remaining portion of the audio signal corresponding to times when the biased value of the first filtered signal is larger than the value of the second filtered signal, the value of the gain signal to a maximum gain value. In some cases, the method can include determining the biased value of the first filtered signal by using a bias factor that is larger than one. For example, the bias factor can be in a range from 1.1 to 10.

In some implementations, the method can include determining the audio signal from input audio signals, the input audio signals including respective instances of the sharp noise, such that the instances of the sharp noise are delayed with respect to each other; determining the amplifier input signal by processing the audio signal; determining an amplified signal by amplifying the amplifier input signal using an amplifier, where the suppressing of the sharp noise from the amplifier input signal is performed by controlling a gain of the amplifier with the gain signal; and outputting the amplified signal from which the sharp noise has been suppressed.

Another aspect of the disclosure can be implemented as a signal processing system that includes an input port to receive an audio signal including sharp noise; a nonlinear filter to determine a first filtered signal from the audio signal; a linear filter to determine a second filtered signal from the audio signal; an amplifier to amplify an amplifier input signal formed based on the audio signal; and a gain suppressor to (i) determine, based on the first filtered signal and the second filtered signal, a portion of the audio signal that corresponds to the sharp noise; (ii) generate, based on the first filtered signal and the second filtered signal, a gain signal that, for the portion of the audio signal corresponding to the sharp noise, has a value that is smaller than a value of the gain signal for the remaining portion of the audio signal; and (iii) control, based on the gain signal, a gain of the amplifier to suppress the sharp noise from the amplifier input signal.

Implementations can include one or more of the following features. In some implementations, the nonlinear filter can include a first low pass filter having a first cutoff frequency to filter the magnitude of the audio signal when a magnitude of a change of the first filtered signal is less than a magnitude of a threshold; and a limiter to (i) limit an increase of the first filtered signal to a positive value of the threshold when the first filtered signal increases by more than the positive value of the threshold, and (ii) limit a decrease of the first filtered signal to a negative value of the threshold when the first filtered signal decreases by more than the negative value of the threshold. In some cases, each of a ratio of the magnitude of the threshold and a root mean square (RMS) variation of the audio signal can be in a range from 1e-4% to 1e-2%. In some cases, the linear filter can include a second low pass filter having a second cutoff frequency to filter the magnitude of the audio signal. For example, the second cutoff frequency can be larger than or equal to the first cutoff frequency.

In some implementations, to determine the portion of the audio signal associated with the sharp noise, the gain suppressor can determine times when a biased value of the first filtered signal is smaller than or equal to a value of the second filtered signal. Here, to generate the gain signal, the gain suppressor can (i) set, for the portion of the audio signal determined to be associated with the sharp noise, a value of the gain signal to a ratio of the biased value of the first filtered signal to the value of the second filtered signal, and (ii) set, for the remaining portion of the audio signal corresponding to times when the biased value of the first filtered signal is larger than the value of the second filtered signal, the value of the gain signal to a maximum gain value. In some cases, the gain suppressor can determine the biased value of the first filtered signal by using a bias factor that is larger than one. For example, the bias factor can be in a range from 1.1 to 10. Further, the gain suppressor can adjust a value of the weight at runtime.

In some implementations, the signal processing system can include a hardware processor; and storage medium encoded with instructions that, when executed by the hardware processor, cause the signal processing system to use the nonlinear filter, the linear filter, and the gain suppressor. In some implementations, the system can be a system on chip.

In some implementations, the signal processing system can include an averager, a delay and a first subtractor to determine the audio signal from input audio signals, the input audio signals including respective instances of the sharp noise, such that the instances of the sharp noise are delayed with respect to each other; and a subtractor that, in conjunction with the averager, determines the amplifier input signal by processing the audio signal. Here, the amplifier can output an amplified signal from which the sharp noise has been suppressed.

The disclosed technologies can result in one or more of the following potential advantages. For example, an audio signal, that includes (i) speech received from a speech direction and (ii) sharp noise received from other directions different from the speech direction, can be processed in accordance with the disclosed technologies. The sharp noise included in the audio signal can be suppressed from the processed audio signal, and the speech included in the audio signal can be maintained in the processed audio signal with minor distortion, such that the speech distortion is hardly noticeable when a user listens to the processed audio signal.

Details of one or more implementations of the disclosed technologies are set forth in the accompanying drawings and the description below. Other features, aspects, descriptions and potential advantages will become apparent from the description, the drawings and the claims.

Certain illustrative aspects of the systems, apparatuses, and methods according to the disclosed technologies are described herein in connection with the following description and the accompanying figures. These aspects are, however, indicative of but a few of the various ways in which the principles of the disclosed technologies may be employed, and the disclosed technologies are intended to include all such aspects and their equivalents. Other advantages and novel features of the disclosed technologies may become apparent from the following detailed description when considered in conjunction with the figures.

DETAILED DESCRIPTION

Figure 1A:
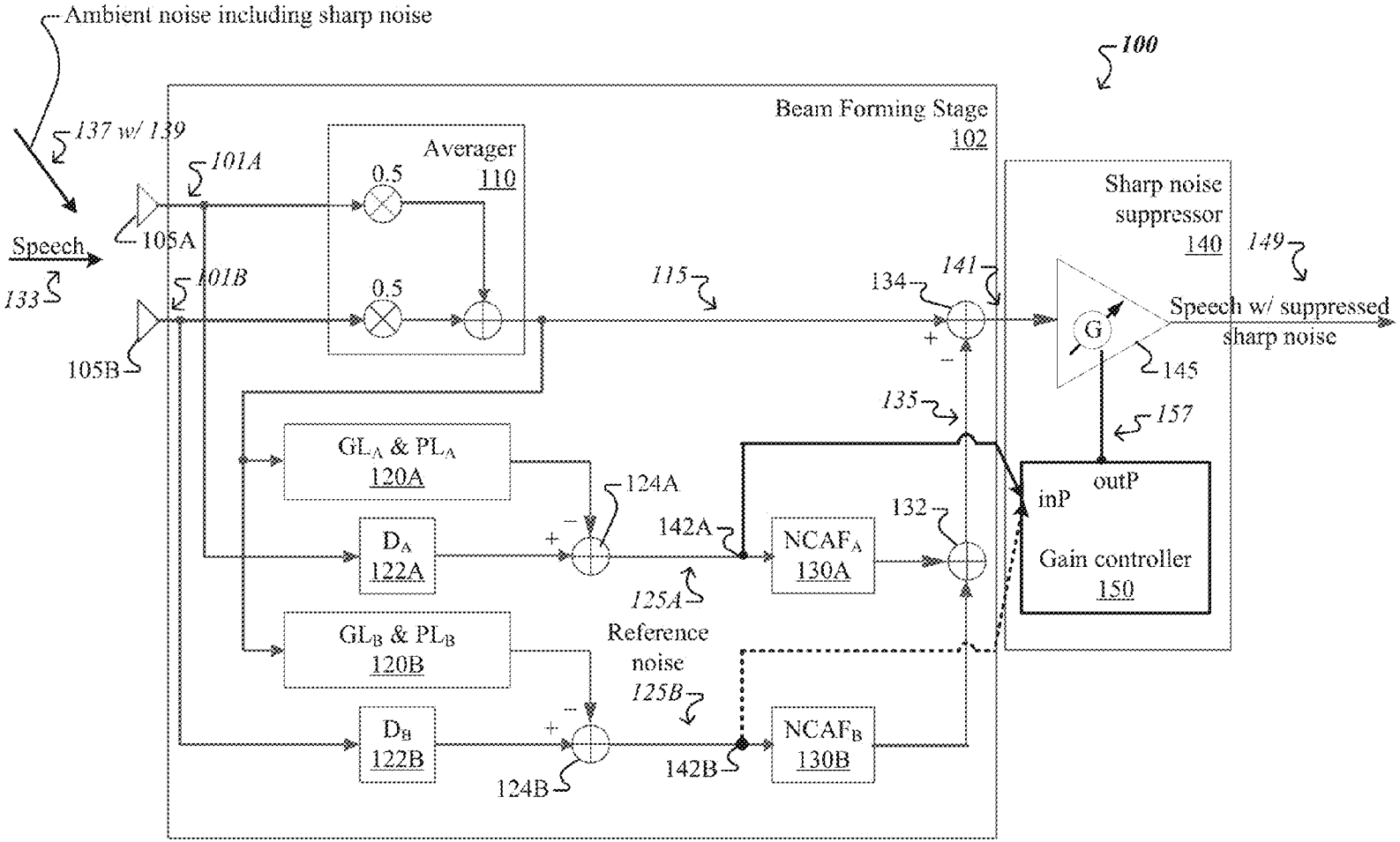
FIG. 1A shows an example of a signal processing system.

FIG. 1A shows an example of a signal processing system 100 that includes a beam forming stage 102 and a sharp noise suppressing stage 140. The beam forming stage 102 has two input ports 105A and 105B configured to receive respective input signals 101A and 101B. Each of the input signals 101A, 101B includes a target signal that arrives at the input ports 105A, 105B along a predetermined direction, and ambient noise that arrives at the input ports along one or more directions different from the predetermined direction. Here, the ambient noise includes sharp noise that, for short time durations, has a level comparable to the level of the target signal. The beam forming stage 102 is configured to suppress portions of the input signals 101A, 101B corresponding to the ambient noise, and output, undistorted, portions of the input signals corresponding to the target signal. As such, the beam forming stage 102 directionally filters the input signals 101A, 101B and outputs a preprocessed signal 141. In other words, the beam forming stage 102 outputs a preprocessed signal 141 that corresponds to a beam that reaches the input ports 105A, 105B along the predetermined direction associated with the target signal. The sharp noise suppressing stage 140 (*i*) receives the preprocessed signal 141, and (ii) further suppresses portions of the preprocessed signal corresponding to the sharp noise based on information determined from a noise-indicating signal (e.g., either instance of reference noise 125A or reference noise 125B) associated with the preprocessed signal, and maintains the portions of the preprocessed signal corresponding to the target signal. As such, the sharp noise suppressing stage 140 outputs a processed signal 149 from which the sharp noise has been suppressed.

The input ports 105A, 105B include respective antennas, microphones, photodetectors or other appropriate transducers to receive the target signal and the ambient noise (including the sharp noise) and to convert them into the input signals 101A, 101B. In some implementations, the input ports 105A, 105B further include analog to digital converters (ADCs), and the input signals 101A, 101B to be processed by the beam forming stage 102 are digital signals.

In the example illustrated in FIG. 1A, the input signals 101A, 101B are audio signals having frequencies in an audio frequency range from 20 Hz to 20 kHz, for instance. As such, the input ports 105A, 105B include respective microphones; the target signal is speech 133 received by the microphones prevalently along a speech direction that is generally orthogonal to a direction that passes through the microphones; and the ambient noise 137 (which includes sharp noise 139) is received by the microphones along one or more propagation directions different from the speech direction. When the input audio signals 101A, 101B to be processed by the beam forming stage 102 are digital signals, a sampling rate of the ADCs included in the input ports 105A, 105B can be $f_S$=8 kHz or 16 kHz, for instance, so the speech received by the input ports can be adequately sampled.

The beam forming stage 102 includes an averager 110 linked to the input ports 105A, 105B; and a subtractor 134 linked to the averager 110. The beam forming stage 102 further includes a subtractor 124A; a gain and phase loop 120A linked to both the averager 110 and the subtractor 124A; and a delay 122A linked to both the input port 105A and the subtractor 124A. Also, the beam forming stage 102 includes an adder 132 linked to the subtractor 134; and a noise cancelation adaptive (NCA) filter 130A linked to both the subtractor 124A and the adder 132. In addition, the beam forming stage 102 includes a subtractor 124B; a gain and phase loop 120B linked to both the averager 110 and the subtractor 124B; a delay 122B linked to both the input port 105B and the subtractor 124B; and a NCA filter 130B linked to both the subtractor 124B and the adder 132. In some embodiments, the beam forming stage 102 is implemented in accordance with the systems and techniques described in U.S. Pat. No. 9,276,618, issued on Mar. 1, 2016, which is hereby incorporated by reference in its entirety.

The sharp noise suppressing stage 140 includes an amplifier 145 that is linked to the subtractor 134 of the beam forming stage 102. The amplifier 145 has controllable gain. The sharp noise suppressing stage 140 further includes a gain controller 150 having an input port (inP) and an output port (outP). The output port of the gain controller 150 is linked to the amplifier 145. In some implementations, the input port of the gain controller 150 is linked to an output 142A of the subtractor 124A of the beam forming stage 102. In some implementations, the input port of the gain controller 150 is linked to an output 142B of the subtractor 124B of the beam forming stage 102.

Figure 1B:
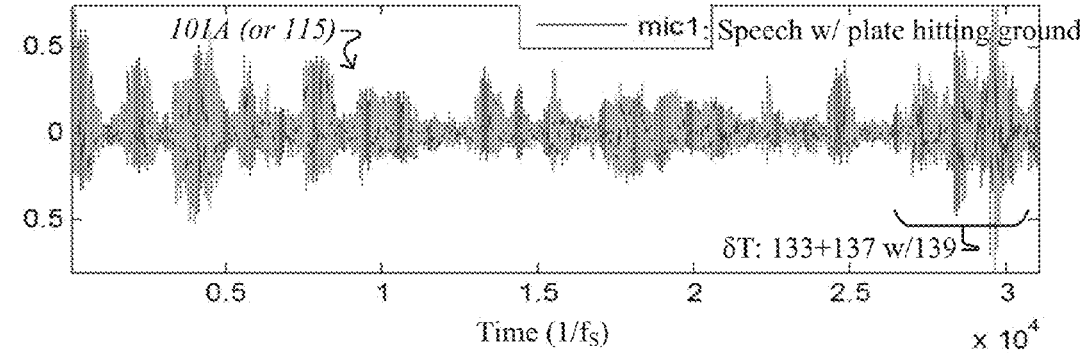
FIGS. 1B-1E show aspects of signals input to, processed by, and output from, the signal processing system of FIG. 1A.

Speech arriving at the input ports 105A, 105B along a speech direction may be received by the input ports at substantially the same time, while the ambient noise arriving at the input ports along directions different from the speech direction is received by the input ports at different times. In this manner, portions of the input audio signals 101A, 101B corresponding to the speech are in phase with each other, while portions of the input audio signals 101A, 101B corresponding to the ambient noise are out of phase with, or delayed with respect to, each other. FIG. 1B shows an example of the input audio signal 101A that includes portions corresponding to speech 133, and portions corresponding to ambient noise 137 that includes sharp noise 139. For example, for a particular time interval δT, the input audio signal 101A has contributions from all of speech 133, (low level) ambient noise 137, and sharp noise 139.

Figure 1C:
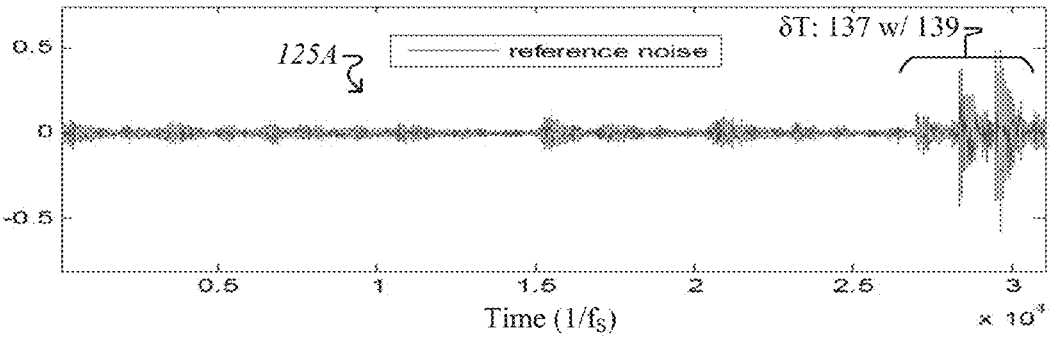

Referring again to FIG. 1A, the averager 110 averages the input audio signals 101A, 101B to obtain an average input audio signal 115. The gain and phase loop 120A adjusts the amplitude and phase of the average input audio signal 115 to obtain a first instance of the adjusted average input audio signal that is a representation of the portions of the input audio signals 101A, 101B corresponding to the speech. The delay 122A adjusts the delay of the input audio signal 101A to obtain a first adjusted input audio signal. The subtractor 124A subtracts the first instance of the adjusted average input audio signal from the first adjusted input audio signal to obtain a first noise-indicating signal 125A (which is a first instance of reference noise). FIG. 1C shows an example of the reference noise 125A that is a representation of the portions of the input audio signals 101A, 101B corresponding to the ambient noise, including portions corresponding to the sharp noise 139. For the particular time interval 6T, the reference noise 125A has contributions from (low level) ambient noise 137, and sharp noise 139.

Referring again to FIG. 1A, the gain and phase loop 120B adjusts the amplitude and phase of the average input audio signal 115 to obtain a second instance of the adjusted average input audio signal that is another representation of the portions of the input audio signals 101A, 101B corresponding to the speech. The delay 122B adjusts the delay of the input audio signal 101B to obtain a second adjusted input audio signal. The subtractor 124B subtracts the second instance of the adjusted average input audio signal from the second adjusted input audio signal to obtain a second noise-indicating signal 125B (which is a second instance of the reference noise) that is another representation of the portions of the input audio signals 101A, 101B corresponding to the ambient noise. The NCA filter 130A filters the reference noise 125A to obtain a first instance of filtered reference noise and the NCA filter 130B filters the reference noise 125B to obtain a second instance of filtered reference noise. The adder 132 adds the first and second instances of the filtered reference noise to obtain a reconstructed noise signal 135 that is a reconstructed version of the portions of the input audio signals 101A, 101B corresponding to the ambient noise. The subtractor 134 subtracts the reconstructed noise signal 135 from the average input audio signal 115 to obtain the preprocessed signal 141.

Figure 1D:
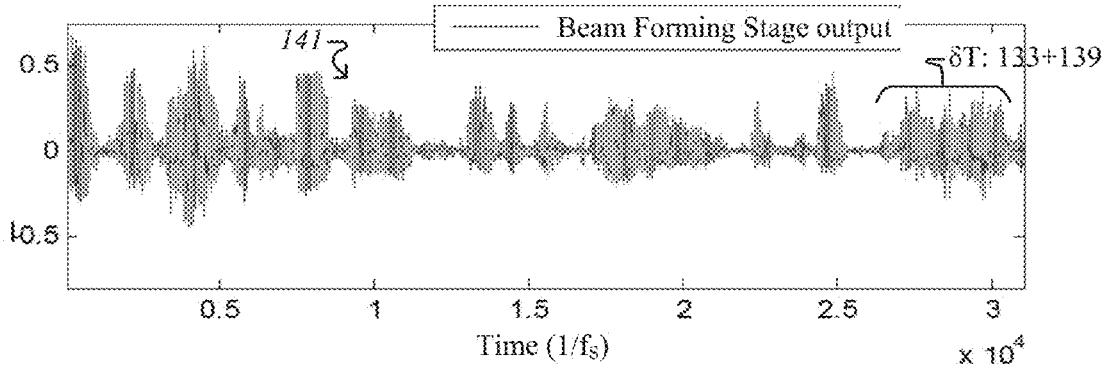

FIG. 1D shows an example of the preprocessed signal 141 that is a representation of the average input audio signal 115 for which portions corresponding to the speech 133 have been reproduced without distortion while portions corresponding to (low level) ambient noise 137 have been suppressed. For the particular time interval 6T, the preprocessed signal 141 has contributions from speech 133, and sharp noise 139. In this example, the contribution of (low level) ambient noise 137 over the particular time interval δT has been suppressed from the preprocessed signal 141 by the action of the beam forming stage 102. As parts of the ambient noise associated with the sharp noise 139 have levels comparable to, or larger than, some portions corresponding to the speech 133, further processing of the preprocessed signal 141 will be performed by the sharp noise suppression stage 140.

Figure 1E:
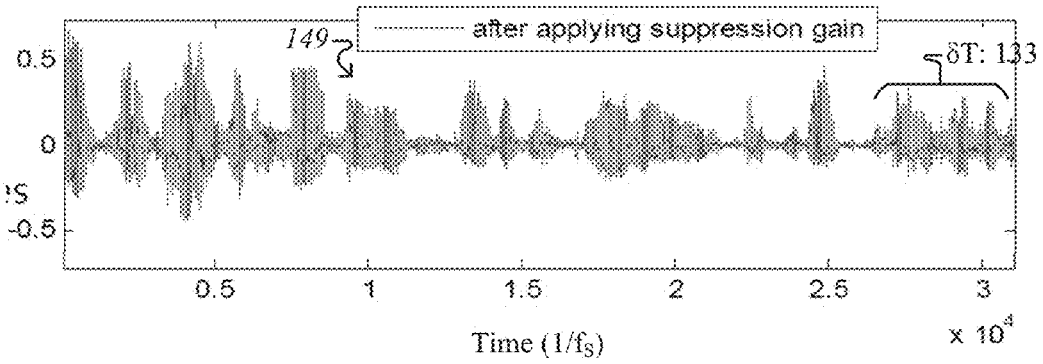

Referring again to FIG. 1A, the gain controller 150 accesses the reference noise 125A (or the reference noise 125B or a combination of 125A and 125B) and determines a gain signal 157 based on the accessed reference noise, as described below in connection with FIG. 2. The amplifier 145 amplifies the preprocessed signal 141, while the amplifier's gain is being controlled by the gain controller 150 based on the gain signal 157, as described below in connection with FIG. 6. In this manner, the amplifier 145 outputs a processed signal 149 from which sharp noise has been suppressed. An example of such processed signal 149 is shown in FIG. 1E. For the particular time interval δT, the processed signal 149 has contributions only from speech 133. In this example, the contribution of sharp noise 139 over the particular time interval δT has been suppressed from the processed signal 149 by the action of the sharp noise suppression stage 140.

Figure 2:
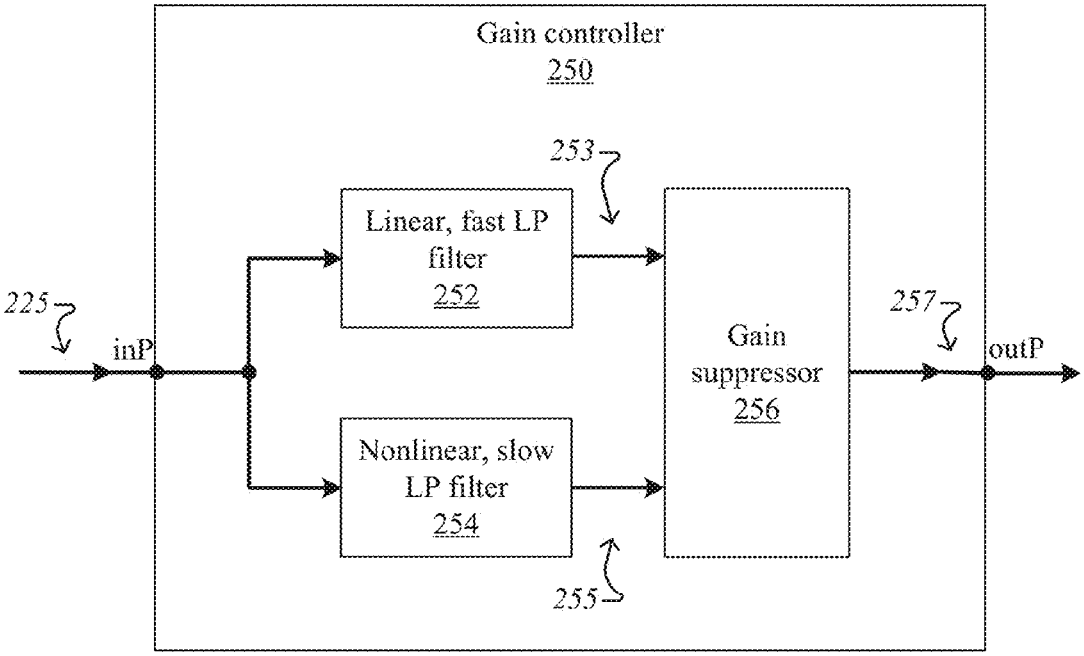
FIG. 2 shows an example of a gain controller.

FIG. 2 shows an example of a gain controller 250. The gain controller 250 has an input port (inP) to receive an audio signal 225 and output port (outP) to output a gain signal 257. In some implementations, the gain controller 250 can be implemented as the gain controller 150 of the sharp noise suppression stage 140 of the signal processing system 100 described above in connection with FIG. 1A. In such cases, the audio signal 225 received at the input port of the gain controller 250 is the reference noise 125A (a waveform of which is shown in FIG. 1C) accessed by the gain controller 150 at the output of the subtractor 124A of the beam forming stage 102. And the output gain signal 257 is the gain signal 157 used by the gain controller 150 to control the gain of the amplifier 145 of the sharp noise suppression stage 140. The gain controller 250 includes a linear filter 252 and a nonlinear filter 254, each of which is linked to the input port (inP). The gain controller 250 further includes a gain suppressor 256 linked to each of the linear filter 252, the nonlinear filter 254 and the output port (outP).

The linear filter 252 filters (as described below in connection with FIG. 3A) the audio signal 225 to obtain a first filtered signal 253. The nonlinear filter 254 filters (as described below in connection with FIG. 3B) the audio signal 225 to obtain a second filtered signal 255. The gain suppressor 256 uses (as described below in connection with FIG. 4A) the first filtered signal 253 and the second filtered signal 255 to (i) identify portions of the audio signal 225 corresponding to sharp noise, and (ii) determine the gain signal 257 that, for the portions of the audio signal corresponding to the sharp noise, has values that are smaller than values of the gain signal for the remaining portions of the audio signal. In this manner, when the audio signal 225 is the reference noise 125A associated with the preprocessed signal 141, the gain signal 257 can be used to control the gain of the amplifier 145 to suppress the sharp noise from the preprocessed signal.

Figure 3A:
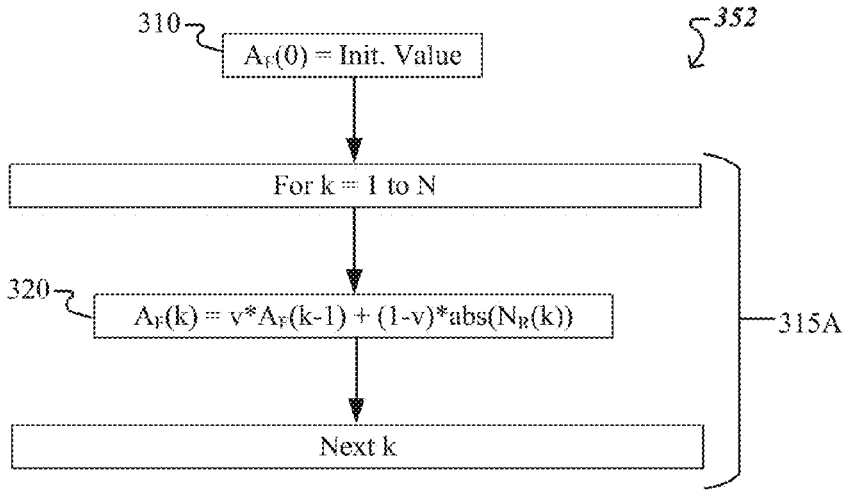
FIG. 3A is a flow chart of an example of a process performed by a linear filter.
Figure 3B:
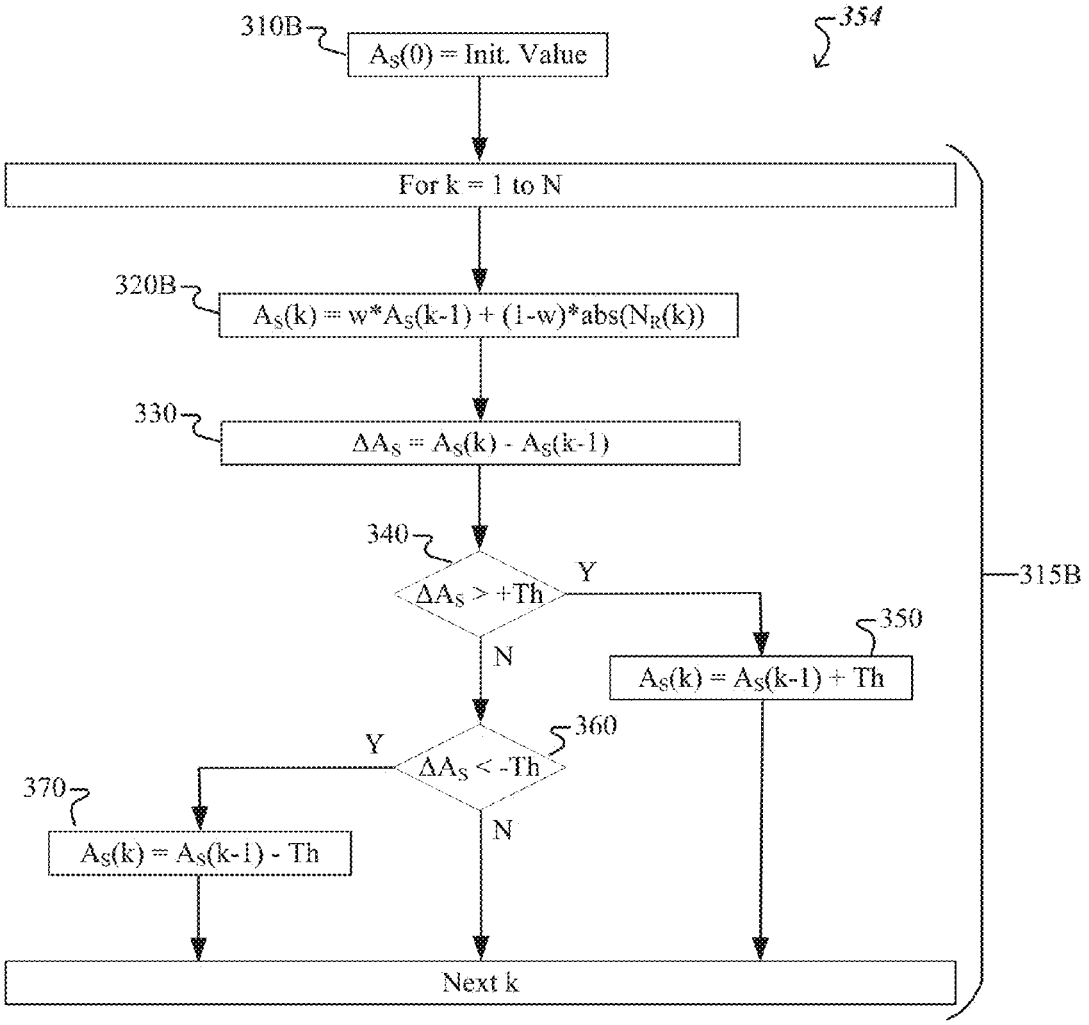
FIG. 3B is a flow chart of an example of a process performed by a nonlinear filter.

FIG. 3A is a flow chart of an example of a process 352 performed by the linear filter 252 to filter the audio signal 225. FIG. 3B is a flow chart of an example of a process 354 performed by the nonlinear filter 254 to filter the audio signal 225. As discussed above, the audio signal 225 is the reference noise 125A (or 125B) when the gain controller 250 which includes the linear filter 252 and the nonlinear filter 254 is implemented as the gain controller 150 that is part of the sharp noise suppressing stage 140. As such, the audio signal 225 is denoted by the symbol $N_R$ in the flow charts of FIG. 3A and FIG. 3B. Here, $N_R(k)$ corresponds with the $k^{th}$ sample of the audio signal $N_R$, where k=0 . . . N. The total number of samples (N+1) may be determined based on the total sampling time $T_S$ and sampling frequency $f_S$, where, for example, $(N+1)=T_S f_S$. For example, as shown in FIG. 1C, for $T_S$=4 sec, and $f_S$=8 kHz, the total number of samples of the reference noise 125A is 3.2e4 samples.

Referring now to FIG. 3A, the first filtered signal 253 is denoted by the symbol $A_F$ in the flow chart of the process 352. As such, $A_F(k)$ corresponds with the $k^{th}$ sample of the first filtered signal $A_F$, where k=0 . . . N.

At 310, the zeroth sample of the first filtered signal $A_F(0)$ is initialized to an initial value. For example, the initial value of $A_F(0)$ can be initialized to zero, for instance. As another example, the initial value of $A_F(0)$ can be set to the magnitude of the zeroth sample of the audio signal $N_R(0)$, i.e., $A_F(0)=\text{abs}(N_R(0))$.

Loop 315A is used to determine the remaining samples of the first filtered signal $A_F$. Each iteration is used to determine a sample of the first filtered signal $A_F(k)$ in the following manner.

At 320, a $k^{th}$ sample of the first filtered signal $A_F(k)$ is determined as a weighted sum of the magnitude of the $k^{th}$ sample of the audio signal $N_R(k)$ and a previous sample of the first filtered signal $A_F(k-1)$. For example, the $k^{th}$ sample of the first filtered signal $A_F(k)$ is determined in the following manner:

$$A_F(k)=vA_F(k-1)+(1-v)\text{abs}(N_R(k)) \quad (1),$$

where v is a first weight, $0 \le v \le 1$. For example, $0.9 \le v \le 0.99$. In Eq. No. (1), the magnitude of the $k^{th}$ sample of the audio signal $N_R(k)$ is determine using the function $\text{abs}(N_R(k))$.

By iteratively performing operation 320 in accordance with Eq. No. (1), the linear filter 252 filters the magnitude of the audio signal $N_R$ using a first low pass filter with a first cutoff frequency $f_{C1}$. The first cutoff frequency $f_{C1}$ depends on the value of the first weight v, such that a low value of the first weight v corresponds to a low value of the first cutoff frequency $f_{C1}$ associated with a slow first low pass filter; and a high value of the first weight v corresponds to a high value of the first cutoff frequency $f_{C1}$ associated with a fast first low pass filter.

Figure 3C:
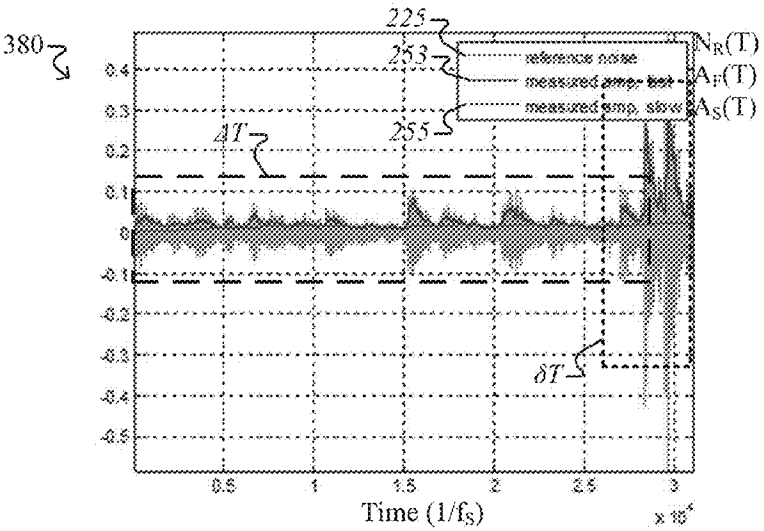
FIGS. 3C-3E show aspects of signals determined by the filters of FIGS. 3A-3B.
Figure 3D:
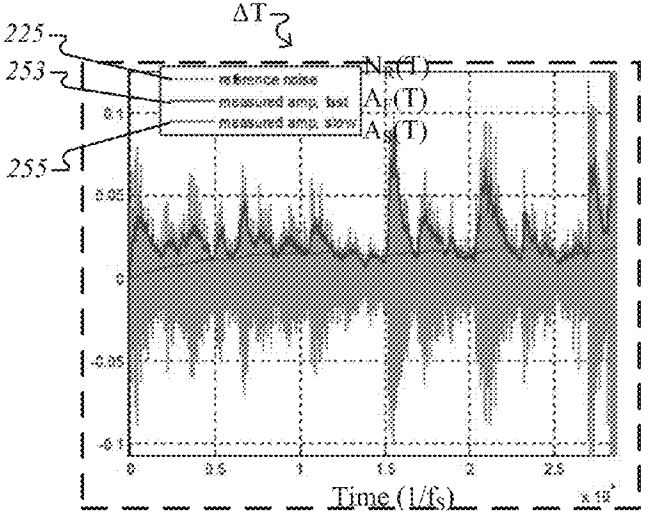
Figure 3E:
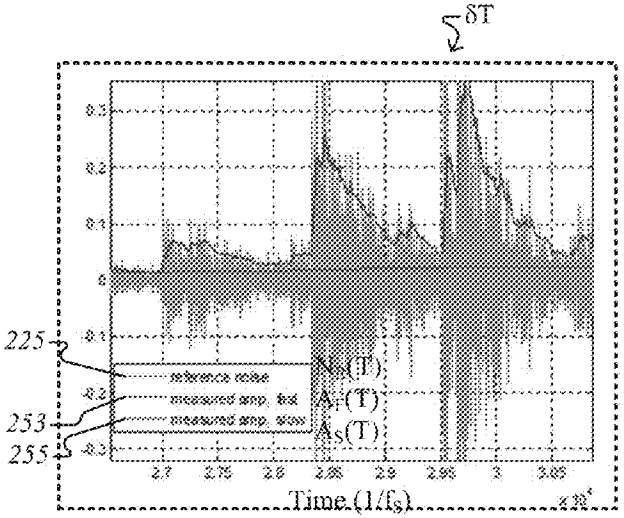

FIG. 3C is a graph 380 that shows the audio signal $N_R$ (also labeled 225) and the first filtered signal $A_F$ (also labeled 253) obtained using process 352. In this example, $N_R$ is a copy of the reference noise 125A shown in FIG. 1C, i.e., $N_R$ is indicative of the ambient noise, which includes sharp noise, received at input ports 105A, 105B of the signal processing system 100. FIG. 3D is a zoomed-in view of a portion of graph 380 over a long time interval ΔT, which is about the first 90% of the total sampling time $T_S$. FIG. 3E is a zoomed-in view of another portion of graph 380 over a short time interval δT, which is about the last 10% of the total sampling time $T_S$. The various views of graph 380 shown in FIGS. 3C, 3D and 3E indicate that the first filtered signal 253 follows relatively well the audio signal $N_R$, suggesting that the linear filter 252 is a fast filter.

Referring now to FIG. 3B, the second filtered signal 255 is denoted by the symbol $A_S$ in the flow chart of the process 354. As such, the symbol $A_S(k)$ corresponds with the $k^{th}$ sample of the second filtered signal $A_S$, where k=0 . . . N.

At 310B, the zeroth sample of the second filtered signal $A_S(0)$ is initialized to an initial value. For example, the initial value of $A_S(0)$ can be initialized to zero, for instance. As another example, the initial value of $A_S(0)$ can be set to the magnitude of the zeroth sample of the audio signal $N_R(0)$, i.e., $A_S(0)=abs(N_R(0))$.

Loop 315B is used to determine the remaining samples of the second filtered signal $A_S$. Each iteration is used to determine a sample of the second filtered signal $A_S(k)$ in the following manner.

At 320B, a $k^{th}$ sample of the second filtered signal $A_S(k)$ is determined as a weighted sum of the magnitude of the $k^{th}$ sample of the audio signal $N_R(k)$ and a previous sample of the second filtered signal $A_S(k-1)$. For example, the kth sample of the second filtered signal $A_S(k)$ is determined in the following manner:

$$A_S(k)=wA_S(k-1)+(1-w)\text{abs}(N_R(k)) \quad (2),$$

where w is a second weight, $0 \le w \le 1$. For example, $0.9 \le w \le 0.99$.

At 330, a change $\Delta A_S$ in the second filtered signal is determined based on a $k^{th}$ sample of the second filtered signal $A_S(k)$ and the prior, $k^{th}-1$ sample of the second filtered signal $A_S(k-1)$. In one example, the change $\Delta A_S$ may be determined based on:

$$\Delta A_S=A_S(k)-A_S(k-1) \quad (3).$$

At 340, it is determined whether the second filtered signal increases by more than a positive value of a threshold. For example, at 340 it is determined if $\Delta A_S>+T_h$, where a magnitude of the threshold is $T_h$. If a result of the determination performed at 340 is true, then, at 350, the change $\Delta A_S$ in the second filtered signal is limited to the positive value of the threshold. For example, the $k^{th}$ sample of the second filtered signal $A_S(k)$ is determined as:

$$A_S(k)=A_S(k-1)+T_h \quad (4).$$

A next iteration of the loop 315B is triggered to determine the next sample of the second filtered signal $A_S(k+1)$ until the value of k is incremented to equal N.

However, if a result of the determination performed at 340 is false, then, at 360, it is determined whether the second filtered signal decreases by more than a negative value of the threshold, $\Delta A_S<-Th$. If a result of the determination performed at 360 is true, then, at 370, the change $\Delta A_S$ in the second filtered signal is limited to the negative value of the threshold. For example, the $k^{th}$ sample of the second filtered signal $A_S(k)$ is determined as:

$$A_S(k)=A_S(k-1)-T_h \quad (5).$$

A next iteration of the loop 315B is triggered to determine the next sample of the second filtered signal $A_S(k+1)$ until the value of k is incremented to equal N. Moreover, if a result of the determination performed at 360 is false, then a next iteration of the loop 315B is still triggered to determine the next sample of the second filtered signal $A_S(k+1)$ until the value of k is incremented to equal N.

When both results of the determination performed at 340 and the determination performed at 360 are false, a magnitude of the change $\Delta A_S$ in the second filtered signal is smaller than a magnitude of the threshold, i.e., abs($\Delta A_S$)_$T_h$. Only when the foregoing inequality is satisfied, a value of the $k^{th}$ sample of the second filtered signal $A_S(k)$ remains as determined at 320B, in accordance with Eq. No. (2). As discussed above in connection with FIG. 3A, performing 320B in accordance with Eq. No. (2) corresponds to filtering the magnitude of the audio signal $N_R$ using a second low pass filter with a second cutoff frequency $f_{C2}$, where a value of the second cutoff frequency $f_{C2}$ depends on the value of the second weight w. Moreover, a value of the second weight w of the second low pass filter used by the nonlinear filter 254 when the condition abs($\Delta A_S$)$\le T_h$ is satisfied, is chosen to be smaller than or at most equal to a value of the first weight v of the first low pass filter used by the linear filter 252, such that the second low pass filter is slower than or at most as fast as the first low pass filter.

Graph 380 in FIG. 3C shows, overlaid on the audio signal $N_R$ (also labeled 225) and the first filtered signal $A_F$ (also labeled 253), the second filtered signal $A_S$ (also labeled 255) obtained using process 354 to filter the audio signal $N_R$ using the nonlinear filter 254. The various views of graph 380 shown in FIGS. 3C, 3D and 3E indicate that the second filtered signal $A_S$ follows relatively poorly the audio signal $N_R$, suggesting that the nonlinear filter 254 is a slow filter.

The flow chart of the process 354 can be summarized using the following portion of pseudo-code:

$$\Delta A_S=0.98A_S(k-1)+0.02\text{abs}(N_R(k))-A_S(k-1);$$

$$\text{If } \Delta A_S>+2\cdot10^{-6}, \text{ then } \Delta A_S=+2\cdot10^{-6};$$

$$\text{If } A_S<-2\cdot10^{-6}, \text{ then } \Delta A_S=-2\cdot10^{-6};$$

$$A_S(k)=A_S(k-1)+\Delta A_S.$$

Here, the threshold magnitude is $T_h=2\cdot10^{-6}$ and the second weight is w=0.98. As shown in FIG. 3D, the foregoing value of the threshold magnitude is about 10-3% of the rms variation of the audio signal $N_R$ over the time interval $\Delta T$. Other values of the threshold magnitude $T_h$ that are in a range from $10^{-4}$% to $10^{-2}$% can be used by the nonlinear filter 254 to determine the second filtered signal 255.

Figure 4A:
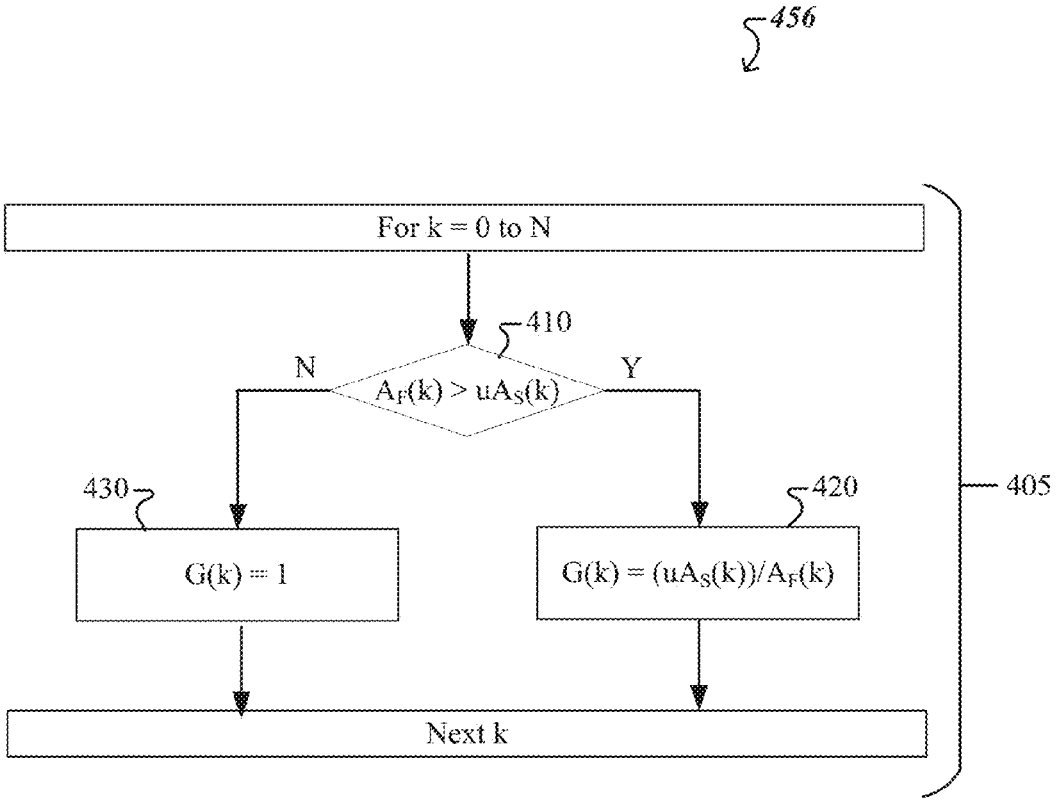
FIG. 4A is a flowchart of an example of a process performed by a gain suppressor.

FIG. 4A is a flow chart of an example of a process 456 performed by the gain suppressor 256 to (i) identify portions of the audio signal 225 corresponding to sharp noise, and (ii) determine the gain signal 257 that, for the portions of the audio signal corresponding to the sharp noise, has values that are smaller than values of the gain signal for the remaining portions of the audio signal. In the flow chart of the process 456, the gain signal 257 is denoted by the symbol G, the first filtered signal 253 is denoted by the symbol $A_F$, and the second filtered signal 255 is denoted by the symbol $A_S$. As such, G(k), $A_F(k)$ and $A_S(k)$ corresponds with the $k^{th}$ sample of the gain signal G, the first filtered signal $A_F$, and the second filtered signal $A_S$, respectively, where k=0 . . . N. Loop 405 is used to determine at least the samples of the gain signal G. Each iteration is used to determine at least a sample of the gain signal G(k) in the following manner.

Figure 4B:
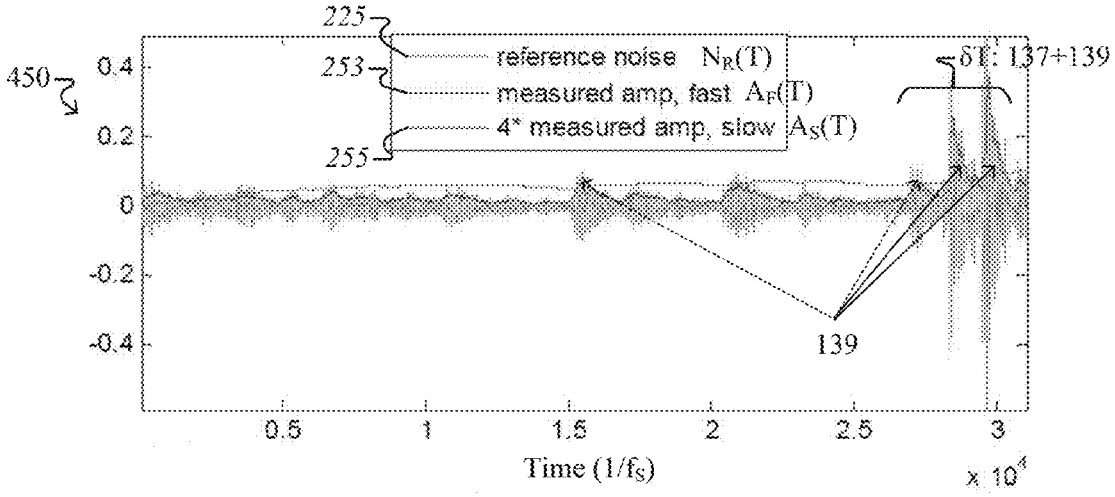
FIG. 4B shows aspects of signals processed by the gain suppressor of FIG. 4A.

At 410, it is determined whether a sampling time associated with the $k^{th}$ sample of the gain signal G(k) belongs to a portion of the audio signal $N_R$ (also labeled 225) that corresponds to sharp noise 139. To make this determination, it is verified whether a biased value of the $k^{th}$ sample of the second filtered signal $uA_S(k)$ is smaller than or equal to a value of the $k^{th}$ sample of the first filtered signal $A_F(k)$. For example, at 410 it may be determined whether $uA_S(k)\le A_F(k)$, where u is a bias factor larger than 1. For example, the bias factor u can have a value that is within a range from 1.1 to 10. FIG. 4B is a graph 450 that shows an overlay of the audio signal $N_R$, the first filtered signal $A_F$, and the biased second filtered signal $uA_S$, where the bias factor u=4. When the test performed at 410 is applied to the signals shown in graph 450, it can be determined that the audio signal $N_R$ includes multiple portions corresponding to sharp noise 139. In graph 450, these portions of the audio signal $N_R$ corresponding to sharp noise 139 correspond to sampling times for which peaks of the first filtered signal $A_F$ rise above the biased second filtered signal $uA_S$.

Referring again to FIG. 4A, if a result of the test performed at 410 is true, then it is determined that the sampling time associated with the gain sample G(k) belongs to a portion of the audio signal $N_R$ that corresponds to sharp noise 139. As such, at 420, a value of the $k^{th}$ sample of the gain signal G(k) is set to a ratio of the biased value of the $k^{th}$ sample of the second filtered signal $uA_S(k)$ to the value of the $k^{th}$ sample of the first filtered signal $A_F(k)$. For example, the gain signal G(k) is determined as follows:

$$G(k) = \frac{uA_S(k)}{A_F(k)}. \tag{6}$$

Because it has been determined at 410 that $uA_S(k)<A_F(k)$ is satisfied, Eq. No. (6) ensures that a value of the $k^{th}$ sample of the gain signal G(k) is less than 1. In this manner, portions of the preprocessed signal 141 that do correspond to sharp noise will be suppressed.

Figure 4C:
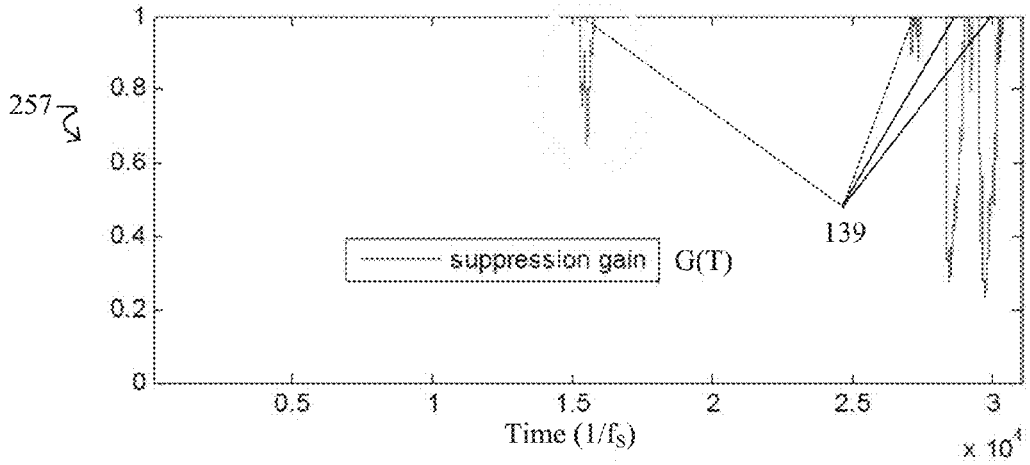
FIG. 4C shows aspects of a gain signal determined by the gain suppressor of FIG. 4A.

Further, the higher the peak of the first filtered signal $A_F(k)$ rises above the biased second filtered signal $uA_S(k)$ (as shown in see FIG. 4B), the smaller the corresponding value of the gain signal G(k) is (as shown in FIG. 4C), and, hence, the more suppressed the corresponding peak of sharp noise 139 from the preprocessed signal 141 will be. At this point, a next iteration of the loop 405 is triggered to determine a value of the next sample of the gain signal Q(k+1) until the value of k is incremented to equal N.

However, if a result of the test performed at 410 is false, it is determined that the sampling time associated with the gain sample G(k) does not belong to a portion of the audio signal $N_R$ that corresponds to sharp noise 139. As such, at 430, a value of the $k^{th}$ sample of the gain signal G(k) can be set to a maximum gain value $G_{MAX}$, for instance. In the example illustrated in FIG. 4A, $G_{MAX}=1$. In this manner, portions of the preprocessed signal 141 that do not correspond to sharp noise will not be suppressed. At this point, a next iteration of the loop 405 is triggered to determine a value of the next sample of the gain signal Q(k+1) until the value of k is incremented to equal N.

FIG. 4C shows the gain signal G (also labeled 257) determined by the gain suppressor 256 using the process 456. As discussed above, values of the gain signal G are suppressed (i.e., G is less than 1) only for sampling times corresponding to sharp noise 139, and a magnitude of the suppression is directly proportional to a magnitude of the sharp noise. Some peaks of the first filtered signal $A_F$, which only marginally rise above the biased second filtered signal $uA_S$ (marked in FIG. 4B with dashed arrows), potentially cause some undesired suppression of the gain signal G (marked in FIG. 4C with dashed arrows). Such undesired suppression of the gain signal G can cause distortion of portions of the preprocessed signal 141 corresponding to speech. The bias factor u, that is used to determine (i) portions of the audio signal $N_R$ and of the gain signal G corresponding to sharp noise 139 and (ii) respective suppression values of the gain signal G, represents a tuning parameter of the gain suppressor 256. In accordance with Eq. No. (6), for larger values of the bias factor u, there would be less undesired suppression of the gain signal G and, thus, less distortion of portions of the preprocessed signal 141 corresponding to speech, however there would be less suppression of portions of the preprocessed signal 141 corresponding to sharp noise 139. Conversely, for smaller values of the bias factor u, there would be more undesired suppression of the gain signal G and, thus, more distortion of portions of the preprocessed signal 141 corresponding to speech, however there would be more suppression of portions of the preprocessed signal 141 corresponding to sharp noise, in accordance with Eq. No. (6).

In some implementations, the tuning of the bias factor u is carried out at design time, before fabrication of the gain controller 250. In some implementations, the tuning of the bias factor u is carried out at fabrication time, before shipping of the gain controller 250 (e.g., either by itself or as part of the signal processing system 100). In some implementations, the tuning of the bias factor u is carried out at run time (i.e., in the field), either by a user through a user interface of the gain controller 250, or by another process that interacts with the gain controller through an application programming interface (API).

Figure 5:
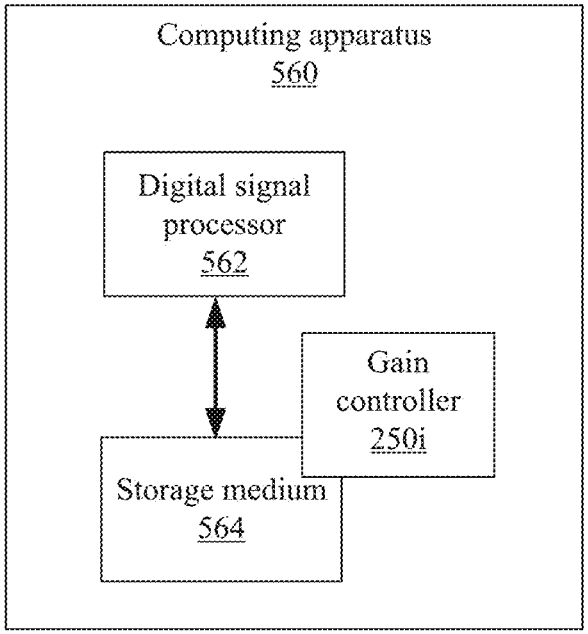
FIG. 5 shows an example of an implementation of a gain controller.

In some implementations, the gain controller 250 can be implemented in software, as illustrated in FIG. 5. Here, a computing apparatus 560 includes a digital signal processor 562 and storage medium 564 (e.g., memory, hard drive, etc.) encoding gain controller instructions 250*i* that, when executed by the digital signal processor, cause the computing apparatus to carry out at least some operations performed by the gain controller 250 as part of processes 352, 354 and 456. In some implementations, the computing apparatus 560 is implemented using one or more integrated circuit devices, such as a system-on-chip (SOC) implementation.

Figure 6:
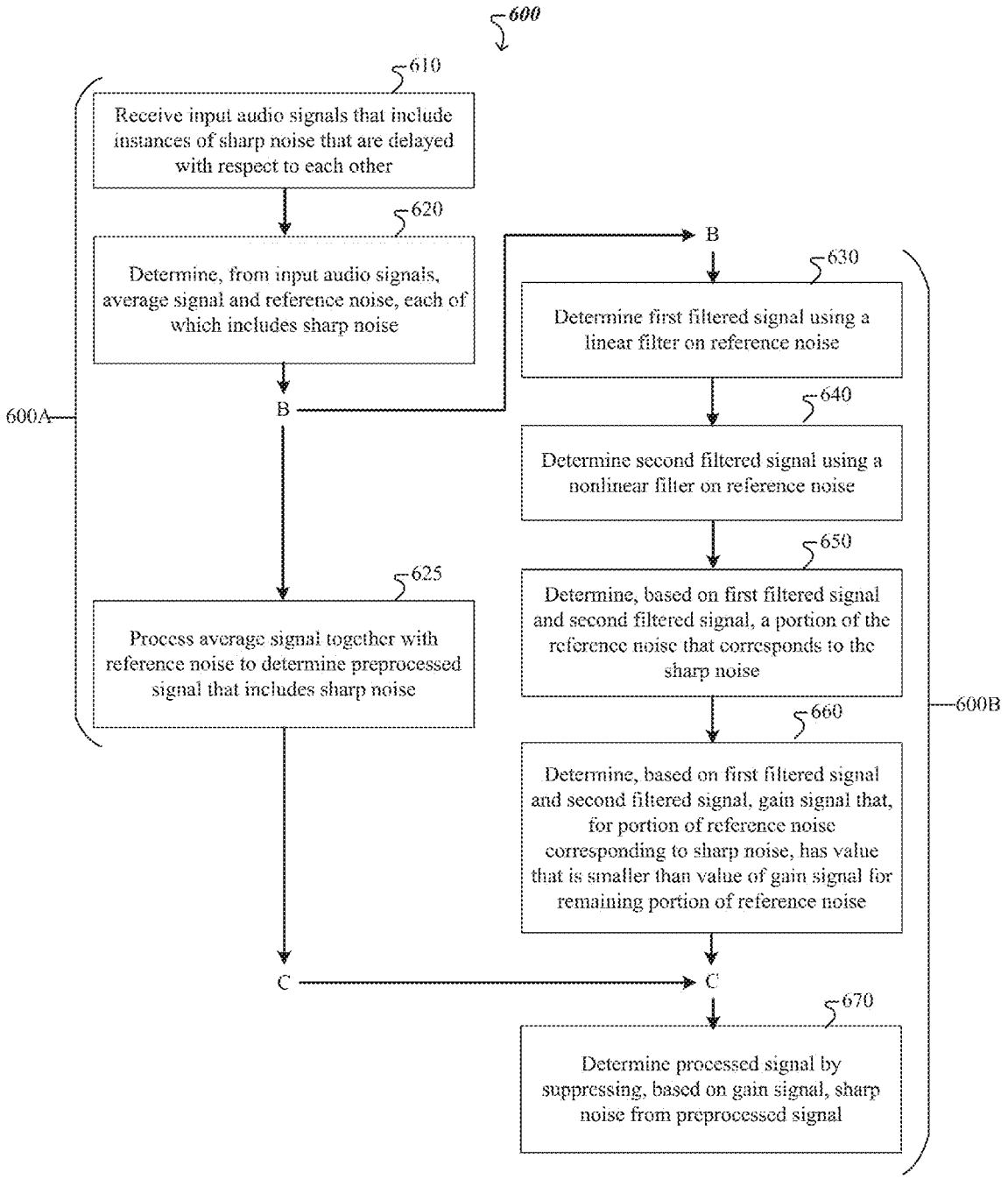
FIG. 6 is a flowchart of a process performed by the signal processing system of FIG. 1A.

FIG. 6 is a flowchart of an example of a process 600 for suppressing sharp noise from one or more audio signals. The process 600 can be performed using the signal processing system 100 that includes the gain controller 150. In some implementations, the gain controller 150 of the signal processing system 100 can be configured like the gain controller 250. Moreover, in some implementations, a portion 600A of the process 600 can be performed by the beam forming stage 102, and another portion 600B of the process 600 can be performed by the gain controller 150.

At 610, the beam forming stage 102 of the signal processing system 100 receives input audio signals 101A, 101B that include speech and ambient noise with sharp noise, such that instances of the ambient noise with the sharp noise are delayed with respect to each other on the input audio signals. The sharp noise can be caused by a plate hitting the ground, or can be caused by keyboard clicks, for instance.

At 620, the beam forming stage 102 determines an average input audio signal 115 and at least one reference noise 125 (e.g., either 125A or 125B or both) based on the input audio signals 101A and 101B. Each of the average input audio signal 115 and the reference noise 125 includes the ambient noise with the sharp noise. Details of the determination of the average input audio signal 115 and of the determination of the reference noise 125 are described above in connection with FIGS. 1A-IC.

Figure 7A:
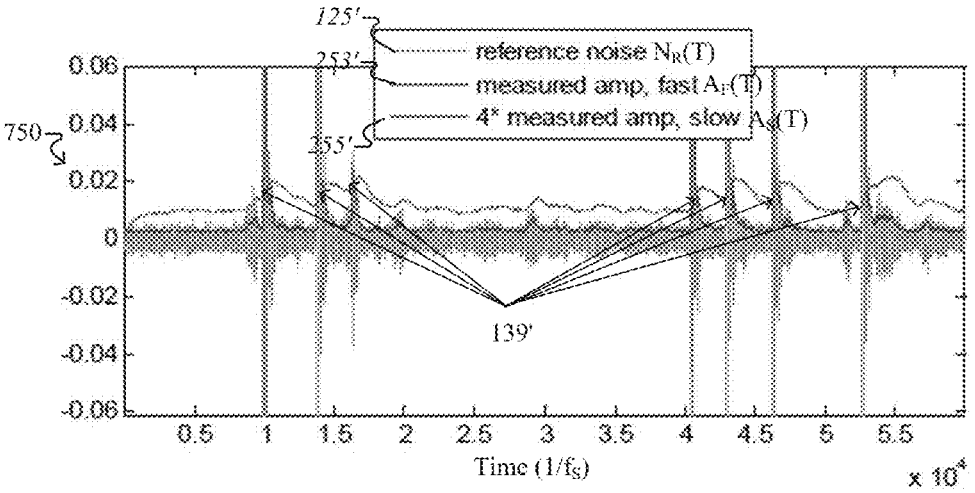
FIGS. 7A-7C and 8A-8C show aspects of signals input to, and output using, the process of FIG. 6.
Figure 7B:
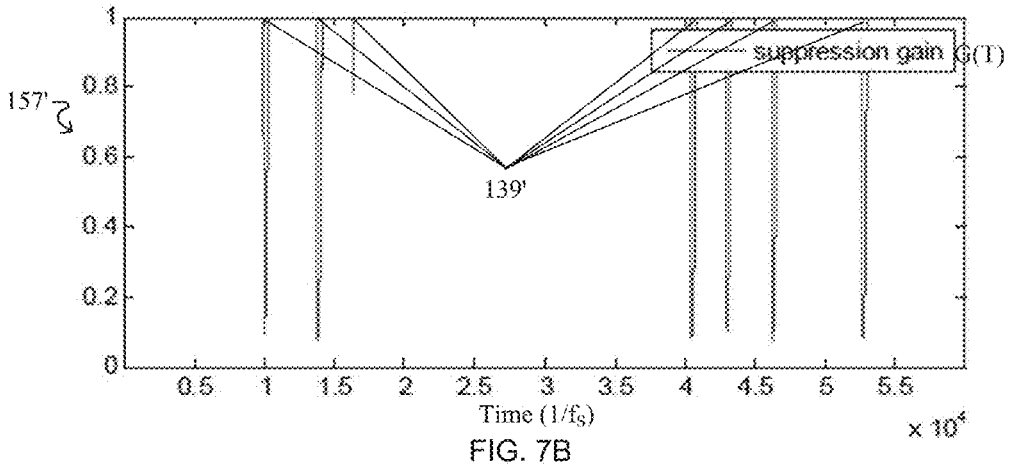
Figure 7C:
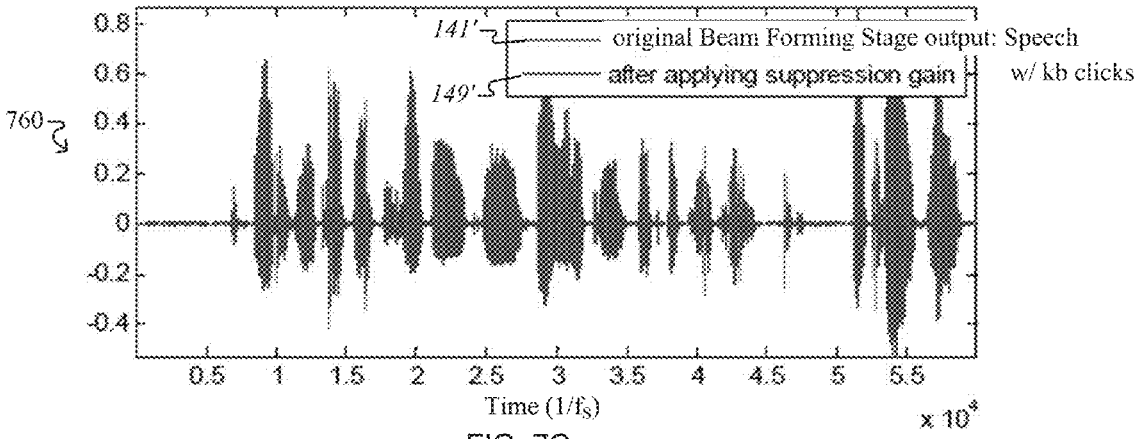
Figure 8A:
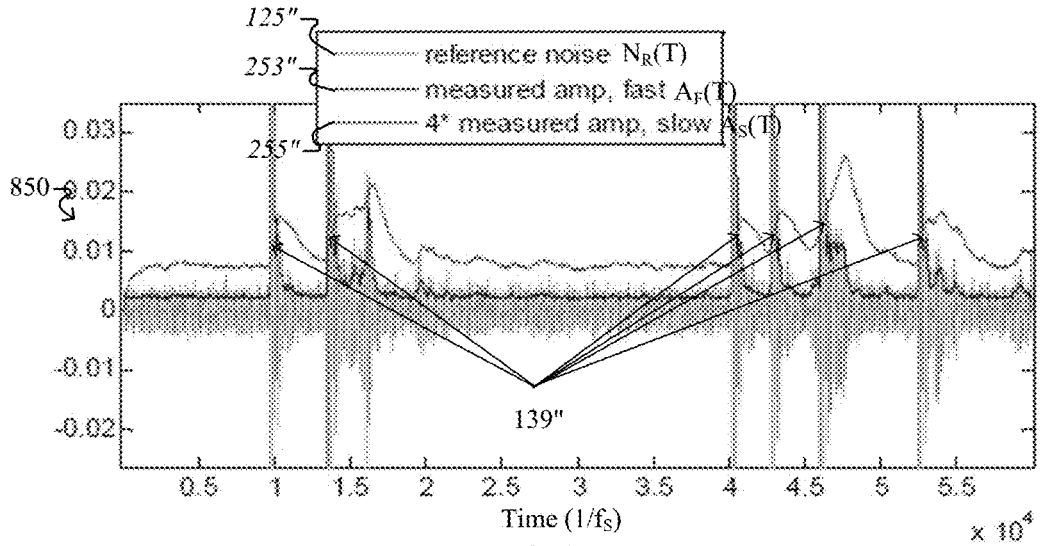
Figure 8B:
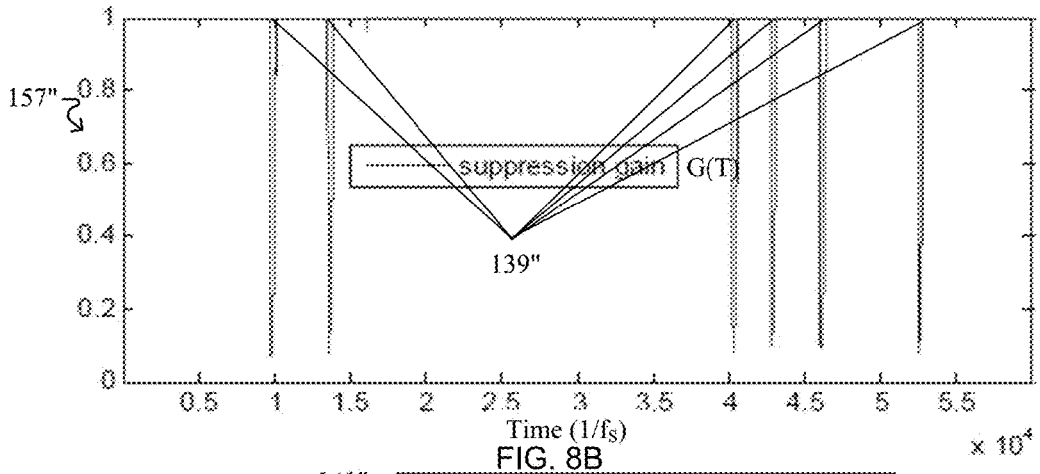
Figure 8C:
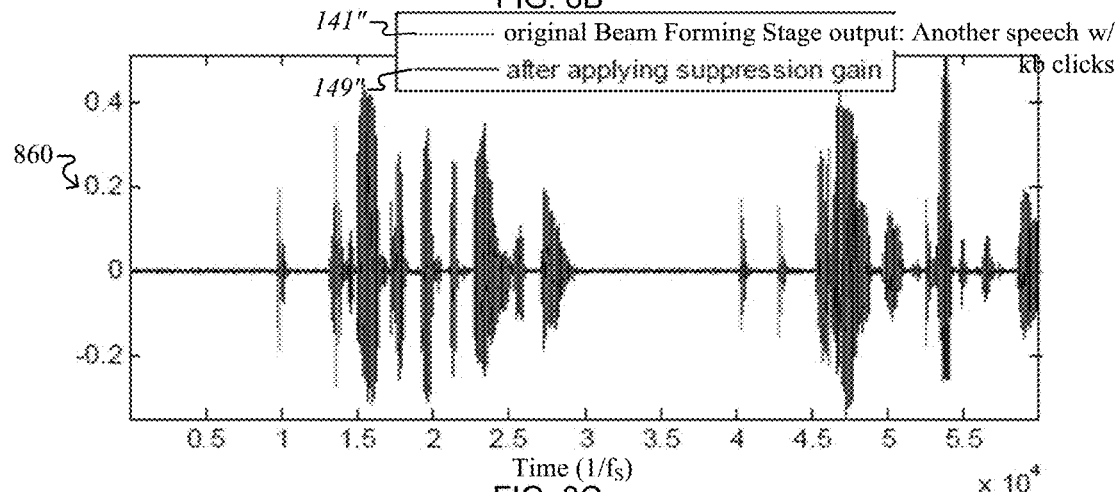

At 625, the beam forming stage 102 processes the average input audio signal 115 together with the at least one reference noise 125 to determine a preprocessed signal 141 (where the latter is also referred to as an amplifier input signal 141). The preprocessed signal 141 includes undistorted speech and the sharp noise of the ambient noise. Here, most of the ambient noise, except for the sharp noise, has been suppressed from the preprocessed signal 141. Details of the processing of the average input audio signal 115 together with the at least one reference noise 125 to determine the preprocessed signal 141 are described above in connection with FIGS. 1A-ID. FIG. 7C is a graph 760 that shows an example of a preprocessed signal 141' determined by the beam forming stage 102 that includes speech and sharp noise caused by keyboard clicks. FIG. 8C is a graph 860 that shows another example of a preprocessed signal 141" determined by the beam forming stage 102 that includes another speech and another sharp noise caused by keyboard clicks.

In parallel, or sequentially, to the beam forming stage 102 performing the operations associated with 625, the sharp noise suppressing stage 140 performs a sequence of operations 630-660, in the following manner.

At 630, the sharp noise suppressing stage 140 determines a first filtered signal using a linear filter on the reference noise 125. To perform 630, the sharp noise suppressing stage 140 uses the gain controller 150, implemented as the gain controller 250 that includes a linear filter 252, as shown in FIG. 2. The linear filter 252 determines the first filtered signal 253 using the process 352 described above in connection with FIGS. 3A, 3C-3E.

At 640, the sharp noise suppressing stage 140 determines a second filtered signal using a nonlinear filter on the reference noise 125. To perform 640, the sharp noise suppressing stage 140 uses the gain controller 150, implemented as the gain controller 250 that includes a nonlinear filter 254, as shown in FIG. 2. The nonlinear filter 254 determines the second filtered signal 255 using the process 354 described above in connection with FIGS. 3B-3E.

At 650, the sharp noise suppressing stage 140 determines, based on the first filtered signal and the second filtered signal, a portion of the reference noise 125 that corresponds to the sharp noise. To perform 650, the sharp noise suppressing stage 140 uses the gain controller 150, implemented as the gain controller 250 that includes the gain suppressor 256, as shown in FIG. 2. The gain suppressor 256 determines the portion of the reference noise 125 that corresponds to the sharp noise using 410 of process 456 described above in connection with FIGS. 4A-4B. FIG. 7A is a graph 750 that shows an overlay of an example of reference noise 125' (determined by the beam forming stage 102 at 620), the corresponding first filtered signal 253' (determined by the sharp noise suppressing stage 140 at 630) and a biased version of the corresponding second filtered signal 255' (the corresponding second filtered signal 255' determined by the sharp noise suppressing stage 140 at 640). Here, portions of the reference noise 125' corresponding to sharp noise (labeled 139') correspond to sampling times for which peaks of the first filtered signal 253' exceed the biased second filtered signal 255'. FIG. 8A is a graph 850 that shows an overlay of another example of reference noise 125" (determined by the beam forming stage 102 at 620), the corresponding first filtered signal 253" (determined by the sharp noise suppressing stage 140 at 630) and a biased version of the corresponding second filtered signal 255" (the corresponding second filtered signal 255" determined by the sharp noise suppressing stage 140 at 640). Here, portions of the reference noise 125" corresponding to sharp noise (labeled 139") correspond to sampling times for which peaks of the first filtered signal 253" exceed the biased second filtered signal 255". A value of 4 was set for the bias factor used to bias the second filtered signal 255' in FIG. 7A and the second filtered signal 255" in FIG. 8A.

At 660, the sharp noise suppressing stage 140 determines, based on the first filtered signal and the second filtered signal, a gain signal 157 that, for a portion of reference noise 125 corresponding to sharp noise, has a value that is smaller than a value of the gain signal for a remaining portion of reference noise. To perform 660, the sharp noise suppressing stage 140 uses the gain controller 150, implemented as the gain controller 250 that includes the gain suppressor 256, as shown in FIG. 2. The gain suppressor 256 determines the gain signal 157 using branches 420 and 430 of the process 456 described above in connection with FIGS. 4A-4C. FIG. 7B illustrates a gain signal 157' relating to the example of reference noise 125' (determined by the beam forming stage 102 at 620 and shown in graph 750). Here, a value of 1 of the gain signal 157' is suppressed for sampling times that correspond to portions of the reference noise 125' corresponding to sharp noise (labeled 139'). A magnitude of the suppression is proportional to a height of peaks of the first filtered signal 253' rising over the biased second filtered signal 255'. FIG. 8B illustrates a gain signal 157" relating to the example of reference noise 125" (determined by the beam forming stage 102 at 620 and shown in graph 850). Here, a value of 1 of the gain signal 157" is suppressed for sampling times that correspond to portions of the reference noise 125" corresponding to sharp noise (labeled 139"). A magnitude of the suppression is proportional to a height of peaks of the first filtered signal 253" rising over the biased second filtered signal 255".

At 670, the sharp noise suppressing stage 140 determines a processed signal 149 (also referred to as an amplifier output signal 149) by suppressing, based on the gain signal 157 (determined at 660 by the sharp noise suppressing stage 140), sharp noise from the preprocessed signal 141 (determined at 625 by the beam forming stage 102). To perform 670, the sharp noise suppressing stage 140 uses the gain controller 150 to control the gain of the amplifier 145 based on the gain signal 157, as described above in connection with FIGS. 1A-1E. In FIG. 7C, graph 760 shows an overlay of (i) an example of preprocessed signal 141' that includes speech and sharp noise caused by keyboard clicks, and (ii) a processed signal 149' corresponding to the preprocessed signal 141'. As shown in graph 760, the sharp noise has been suppressed from the processed signal 149'. Because the gain signal 157' (shown in FIG. 7B) causes the amplifier 145 to suppress only portions of the preprocessed signal 141' corresponding to sharp noise, the processed signal 149' includes undistorted speech, as shown in graph 760. In FIG. 8C, graph 860 shows an overlay of (i) another example of preprocessed signal 141" that includes another speech and sharp noise caused by keyboard clicks, and (ii) a processed signal 149" corresponding to the preprocessed signal 141". As shown in graph 860, the sharp noise has been suppressed from the processed signal 149". Because the gain signal 157" (shown in FIG. 8B) causes the amplifier 145 to suppress only portions of the preprocessed signal 141" corresponding to sharp noise, the processed signal 149" includes undistorted speech, as shown in graph 860.

Figure 9:
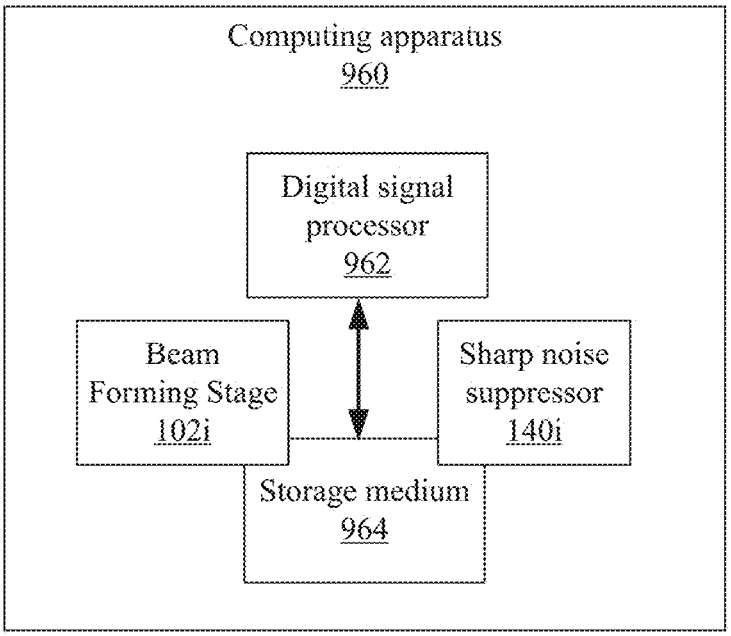
FIG. 9 shows an example of an implementation of a beam forming stage and a sharp noise suppressing stage of the signal processing system of FIG. 1A.

In some implementations, the beam forming stage 102 and the sharp noise suppressing stage 140 can be implemented in software, as illustrated in FIG. 9. Here, a computing apparatus 960 includes a digital signal processor 962 and storage medium 964 (e.g., memory, hard drive, etc.) encoding beam forming stage instructions 102*i* and sharp noise suppressor instructions 140*i* that, when executed by the digital signal processor, cause the computing apparatus to carry out at least some operations performed by the beam forming stage 102 and the sharp noise suppressing stage 140 as part of the process 600. In some implementations, the computing apparatus 960 is implemented using one or more integrated circuit devices, such as a system-on-chip (SOC) implementation.

A few embodiments have been described in detail above, and various modifications are possible. The disclosed subject matter, including the functional operations described in this specification, can be implemented in electronic circuitry, computer hardware, firmware, software, or in combinations of them, such as the structural means disclosed in this specification and structural equivalents thereof, including system on chip (SoC) implementations, which can include one or more controllers and embedded code.

While this specification contains many specifics, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

Other embodiments fall within the scope of the following claims.

What is claimed is:

1. A method comprising:

determining, by a first filter, a first filtered signal based on an audio signal;

determining, by a second filter, a second filtered signal based on the audio signal;

determining, by a gain suppressor coupled with the first filter and the second filter, based on the first filtered signal and the second filtered signal, a portion of the audio signal corresponding to a sharp noise, wherein the portion of the audio signal determined to be associated with the sharp noise corresponds to times when a biased value of the first filtered signal is smaller than or equal to a value of the second filtered signal;

determining, by the gain suppressor based on the first filtered signal and the second filtered signal, a gain signal that, for the portion of the audio signal corresponding to the sharp noise, has a value that is smaller than a value of the gain signal for the remaining portion of the audio signal, wherein the determining of the gain signal comprises:

setting, for the portion of the audio signal determined to be associated with the sharp noise, a value of the gain signal to a ratio of the biased value of the first filtered signal to the value of the second filtered signal, and setting, for the remaining portion of the audio signal corresponding to times when the biased value of the first filtered signal is larger than the value of the second filtered signal, the value of the gain signal to a maximum gain value; and suppressing, by the gain suppressor based on the gain signal, the sharp noise from an amplifier input signal determined based on the audio signal.

2. The method of claim 1, wherein the determining of the first filtered signal comprises using a first low pass filter, which has a first cutoff frequency, on a magnitude of the audio signal, limiting an increase of the first filtered signal to a positive value of a threshold, when the first filtered signal increases by more than the positive value of the threshold, and limiting a decrease of the first filtered signal to a negative value of the threshold, when the first filtered signal decreases by more than the negative value of the threshold.

3. The method of claim 2, wherein a ratio of the threshold and a root mean square (RMS) variation of the audio signal is in a range from 1e-4% to 1e-2%.

4. The method of claim 2, wherein the determining of the second filtered signal comprises using a second low pass filter, which has a second cutoff frequency, on the magnitude of the audio signal.

5. The method of claim 4, wherein the second cutoff frequency is larger than or equal to the first cutoff frequency.

6. The method of claim 1, comprising determining the biased value of the first filtered signal by using a bias factor that is larger than one.

7. The method of claim 6, wherein the bias factor is in a range from 1.1 to 10.

8. The method of claim 1, comprising:

determining the audio signal from input audio signals, the input audio signals including respective instances of the sharp noise, such that the instances of the sharp noise are delayed with respect to each other;

determining the amplifier input signal by processing the audio signal;

determining an amplified signal by amplifying the amplifier input signal using an amplifier, wherein the suppressing of the sharp noise from the amplifier input signal is performed by controlling a gain of the amplifier with the gain signal; and outputting the amplified signal from which the sharp noise has been suppressed.

9. A signal processing system comprising:

an input port to receive an audio signal comprising sharp noise;

a first filter to determine a first filtered signal from the audio signal;

a second filter to determine a second filtered signal from the audio signal;

an amplifier to amplify an amplifier input signal formed based on the audio signal; and a gain suppressor to determine, based on the first filtered signal and the second filtered signal, a portion of the audio signal that corresponds to the sharp noise, by determining times when a biased value of the first filtered signal is smaller than or equal to a value of the second filtered signal, and generate, based on the first filtered signal and the second filtered signal, a gain signal that, for the portion of the audio signal corresponding to the sharp noise, has a value that is smaller than a value of the gain signal for the remaining portion of the audio signal, by (i) setting, for the portion of the audio signal determined to be associated with the sharp noise, a value of the gain signal to a ratio of the biased value of the first filtered signal to the value of the second filtered signal, and (ii) setting, for the remaining portion of the audio signal corresponding to times when the biased value of the first filtered signal is larger than the value of the second filtered signal, the value of the gain signal to a maximum gain value; and control, based on the gain signal, a gain of the amplifier to suppress the sharp noise from the amplifier input signal.

10. The signal processing system of claim 9, wherein the first filter comprises a first low pass filter having a first cutoff frequency to filter a magnitude of the audio signal; and a limiter to (i) limit an increase of the first filtered signal to a positive value of a threshold when the first filtered signal increases by more than the positive value of the threshold, and (ii) limit a decrease of the first filtered signal to a negative value of the threshold when the first filtered signal decreases by more than the negative value of the threshold.

11. The signal processing system of claim 10, wherein a ratio of the threshold and a root mean square (RMS) variation of the audio signal is in a range from 1e-4% to 1e-2%.

12. The signal processing system of claim 10, wherein the second filter comprises a second low pass filter having a second cutoff frequency to filter the magnitude of the audio signal.

13. The signal processing system of claim 12, wherein the second cutoff frequency is larger than or equal to the first cutoff frequency.

14. The signal processing system of claim 9, wherein the gain suppressor is to determine the biased value of the first filtered signal by using a bias factor that is larger than one.

15. The signal processing system of claim 14, wherein the bias factor is in a range from 1.1 to 10.

16. The signal processing system of claim 14, wherein the gain suppressor is further to adjust a value of the bias factor at runtime.

17. The signal processing system of claim 9, comprising a hardware processor, and storage medium encoded with instructions that, when executed by the hardware processor, cause the signal processing system to use the first filter, the second filter, and the gain suppressor.

18. The signal processing system of claim 9, wherein the system is a system on chip.

19. The signal processing system of claim 9, further comprising:

an averager, a delay and a first subtractor to determine the audio signal from input audio signals, the input audio signals including respective instances of the sharp noise, such that the instances of the sharp noise are delayed with respect to each other; and a subtractor that, in conjunction with the averager, to determine the amplifier input signal by processing the audio signal, wherein the amplifier is to output an amplified signal from which the sharp noise has been suppressed.

* * * * *